United States Patent [19]

Beard et al.

[11] 3,958,205

[45] May 18, 1976

[54] OPEN LINK TOTAL RANGE FAULT INTERRUPTER

[75] Inventors: Lloyd Ronald Beard; Allen Houpt Knepper, both of Centralia, Mo.

[73] Assignee: A. B. Chance Company, Centralia, Mo.

[22] Filed: Dec. 23, 1974

[21] Appl. No.: 535,491

[52] U.S. Cl. ..... 337/178; 337/186

[51] Int. Cl.[2] ..... H01H 71/20

[58] Field of Search ..... 337/211, 229, 178, 186, 337/217, 204, 180, 155

[56] References Cited

UNITED STATES PATENTS

| | | | |
|---|---|---|---|
| 2,324,044 | 7/1943 | Triplett et al. | 337/211 |
| 2,376,996 | 5/1945 | Fox | 337/211 |
| 3,810,060 | 5/1974 | Hubbard | 337/155 |
| 3,863,187 | 1/1975 | Mahieu et al. | 337/229 |

*Primary Examiner*—Harold Broome

*Attorney, Agent, or Firm*—Schmidt, Johnson, Hovey & Williams

[57] ABSTRACT

A lightweight, compact, conductor-mounted open link fault interrupter having mounting means permitting suspension thereof directly from an overhead power line without the need of cumbersome pole-mounting structure. Pinwheeling and flashover problems heretofore encountered during operation of conductor-mounted, closed link interrupters are precluded by virtue of the open link, fusible element employed since through use thereof no net rotational forces are imparted to the interrupter during its operation. The interrupter hereof provides especially advantageous protection when electrically connected in series with a unique high range current limiting fuse capable of safely interrupting high magnitude fault current to insignificant values substantially ahead of the first natural zero point. The resultant combination device is operable to limit the electrical energy dissipated in the conductor carrying the fault current to a desired level in a manner functionally independent of fault current magnitude, and thus provides an appropriate, relatively narrow $I^2t$ band response over the entire fault range to effectively protect an electrical distribution circuit without impairing desirable coordination of the overall system.

15 Claims, 7 Drawing Figures

OPEN LINK TOTAL RANGE FAULT INTERRUPTER

The present invention is concerned with a lightweight, compact, line-mounted fault interrupter adapted to be suspended from an elongated overhead conductor without the need for heavy, cumbersome utility pole mounting structure. More particularly, it pertains to such a fault interrupter having novel line-mounting means thereon which permits use of an open link fusible element therein which precludes problems of pinwheeling and flashover often encountered with conductor-mounted, closed link interrupters by virtue of the high velocity stream of hot expulsion gasses emitted during operation of the latter. The interrupter hereof is particularly effective regardless of the fault conditions imposed thereon by virtue of the provision of an unique high range current limiting fuse structure which is connected in series with the open link conductor-mounted fuse, thus producing a full range protective device operable to safely and satisfactorily interrupt all values of fault currents to which the line can be subjected.

In order to operate most effectively, electrical transmission and distribution lines are necessarily protected against faults in a "coordinated" manner which, in general, refers to system protection at various levels down the circuit. Basically, protection on a coordinated basis implies a series of "zones" along the system protected at different fault levels. For example, from a substation there is generally a circuit breaker or power fuse. Going down the circuit away from the substation are sectionalizing devices which may be reclosures or cutouts on branch lines. These are conventionally fused at a lesser value than the circuit breaker of the substation, but at a greater value than cutouts further down the circuit. Further out on the circuit from the branch cutouts, there are adiitional cutouts and finally transformer applied cutouts. With these devices, each having varying minimum melting and total clearing times, there can be many zones of protection, and thus extremely good coordination of protection along the entire system.

The most common protective device used in coordinated electrical distribution systems is the well-known expulsion cutout referred to above. This device usually consists of a cross-arm mounted, elongated insulative support having spaced contact arms thereon electrically connected to respective input and output conductors connected to the device. A pivotally mounted fuse link tube is connected between the spaced contact arms, and a biased fusible link is carried within the tube to complete the circuit through the device. When a fault current of predetermined magnitude is experienced by the link, melting or severing occurs with the expulsion of gases from the lower end of the fuse link tube. Following severing of the fuse link, the fuse link tube is subsequently pivoted out of contact with the upper contact on the support to thereby electrically and mechanically break the electrical circuit through the cutout.

While the cutouts described above provide excellent system protection in most cases, they are deficient when specialized conditions must be met. For example, in many areas it has become common practice to string overhead power lines on armless utility poles. In such cases it is sometimes impossible to employ conventional cutouts in association therewith, because such devices are generally relatively heavy and frequently cannot be safely connected and allowed to depend from the conductors themselves. Furthermore, when it has been possible to so mount conventional cutouts, a number of serious and heretofore unsolved problems have arisen. Most importantly, during operation of such line-mounted, closed link cutouts, the stream of hot expulsion gases generated during operation tends to create a torque-like thrust which causes rotation or "pinwheeling" of the cutout about an axis defined by the conductor. As can be appreciated, this is an objectionable result because of the fact that such pinwheeling tends to damage the conductor and moreover loosen the connection between the conductor and the cutout itself, both of which can lead to premature failure.

Additionally, the hot, concentrated stream of expulsion gases which are directed from the lower end of the fuse link tube during conventional other operation can cause serious problems of flashover and/or scorching of underlying electrical apparatus. Electrical apparatus such as transformers or the like can become enveloped in such conductive gases causing an arc between the spaced contacts thereof, which can result in serious explosions and othe untoward disturbances.

Another problem associated with conventional cutouts results from the fact that they are capable of safely interrupting fault currents of only relatively low magnitude. With increasingly heavy consumer demand for electrical power, suppliers have necessarily resoted to the use of equipment capable of transmitting currents of higher magnitudes, and correspondingly the fault currents sometimes experienced may exceed the capabilities of conventional expulsion cutouts. For example, standard commercially available cutouts are generally capable of interrupting currents of up to only about 20,000 amperes, while fault currents of twice that magnitude are sometimes experienced in practice. When a fault current of such high magnitude passes through a normal cutout, the latter is often completely blown up with excessive voilence and noise, which, of course, is an extremely dangerous occurrence in residential or work areas. In addition, transformers supposedly protected by such cutout devices have also blown up in practice because of excessive fault current loads imposed thereon, notwithstanding the cutout protection provided therefor. Accordingly, utilities have for some time needed a full range current limiting device operable to faithfully limit fault currents of widely varying magnitudes while at the same time preserving the requisite system coordination.

As disclosed in the assignee's copending patent application Ser. No. 366,343 entitled "TOTAL RANGE FAULT INTERRUPTER," to which reference is made and incorporated herein by reference, conventional low range fault interrupting devices such as closed link cutouts can be electrically connected in series with unique current limiting fuse structure to provide a full range device of the desirable characteristics outlined. As disclosed therein, the novel current limiting fuse structure in combination with a low range fault interrupting device provides an appropriate, relatively narrow $I^2t$ band response over the entire fault range and effectively protects an electrical distribution circuit without impairing desirable protection coordination of the overall system. However, the problems associated with providing a full range fault current protecting device for use in situations where standard cutouts are inoperative or inconvenient has not been completely solved, by virtue of the deficiencies noted above with respect to line-mounted, low range interrupters.

Hence, there has been an unresolved need in the art for a low cost, lightweight current interrupter of the open-link variety which can be suspended from an overhead power line without the need for separate utility pole mounting structure and which is operable to be connected in electrical series with a compact current limiting fuse to yield a combination device which gives protection against widely varying fault current conditions without destroying desirable circuit coordination.

It is therefore an object of the present invention to provide a lightweight, compact, line-mounted current interrupter which is not susceptible to pinwheeling or creation of falshover-inducing expulsion gas streams by utilization therein of an open link cutout having mounting means thereon permitting the device to be suspended from an overhead conductor in a depending fashion, and including an open-link fusible element operable to sever under a fault current of predetermined magnitude. In this manner, a net rotational force of zero is imparted to the device during operation thereof, and the gases produced upon severing of the open-fuse link do not form an objectionable flashover-inducing stream but rather rise upwardly in a relatively unconcentrated cloud or plume.

Another object of the invention is to provide a total range interrupter of the characteristics described having conductor-mounting means thereon which can be safety and easily manipulated in the field with conventional hot line tools, and which can be optionally suspended from a conductive bail clamp which is in turn attached to an overhead power line. Provision of such a bail clamp reduces wear and tear on the load-carrying conductor and facilitates removal and servicing of the interrupter in the field since any arcing created thereby does not affect the energized conductor itself, but rather the expendable bail clamp attached thereto.

Yet another object of the invention is to provide an open link current interrupter of the class described which includes spring-biased fuse support arms operable to spread upon severence of the open fuse link therebetween, thus increasing the potential arcing distance between the conductive support arms and giving a positive indication of operation to linemen at ground level in the field.

A still further object of the invention is to provide a full range current limiting protective device employing a line-mounted, open link current interrupter as described in combination with a unique, compact, lightweight current limiting fuse structure electrically connected in series therewith. The total range device produced thereby is especially adapted for armless distribution system construction and is capable of interrupting low magnitude fault currents at the first natural zero point thereof, while at the same time having the capability of limiting high magnitude fault currents to insignificant values substantially ahead of the first natural zero point whereby the interrupter is operable to limit the electrical energy dissipated in the conductors carrying the fault current to a desired level in a manner functionally independent of fault current magnitude.

As a correlary to the foregoing it is also an object of the invention to provide a combination full range protective device which includes an operational indicator which is actuated in both high and low magnitude fault situations and can easily be observed at ground level by linemen in the field.

Still another object of the present invention is to provide a full range circuit limiting protective device which is operable to be interconnected at different zones along a transmission and distribution electrical circuit without in any way detracting from the desirable coordination thereof, and which can be mounted directly onto electrical apparatus such as transformers without the need of costly mounting structure therefor.

Other objects of the invention will be apparent from a study of the description provided hereinafter.

Figure 7:
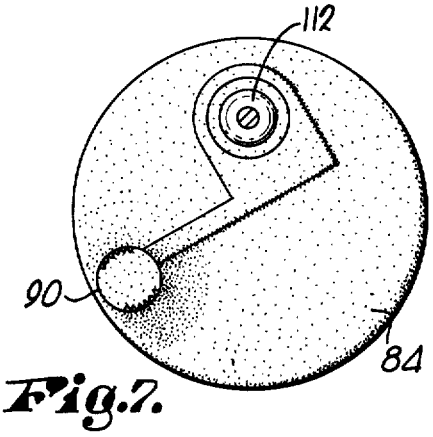
Figure 4:
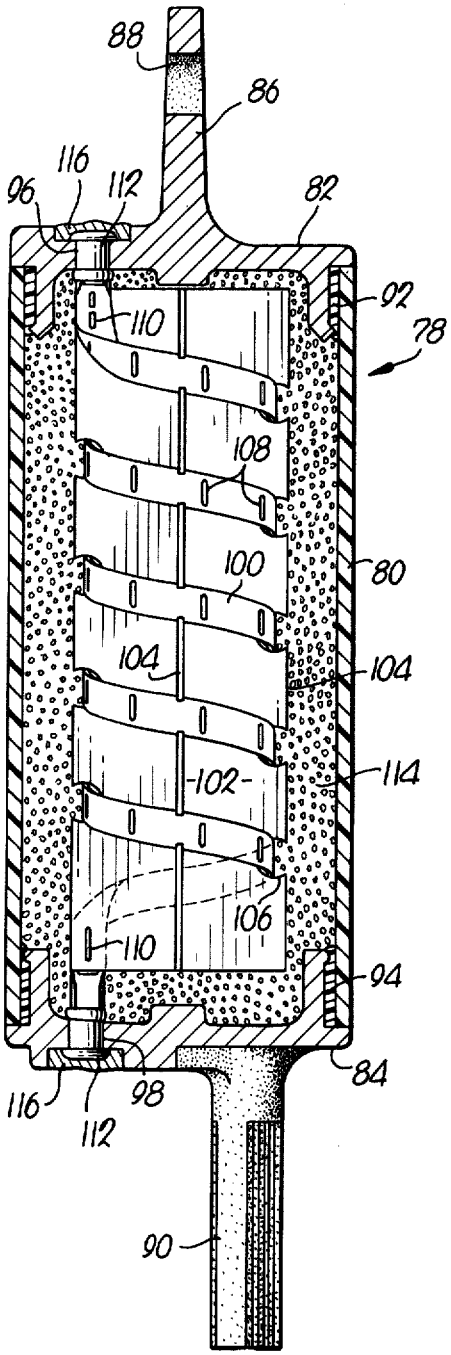
FIG. 4 is an enlarged view in vertical section showing a current limiting fuse for use with the open link fault interrupter depicted in FIG. 1.
Figure 6:
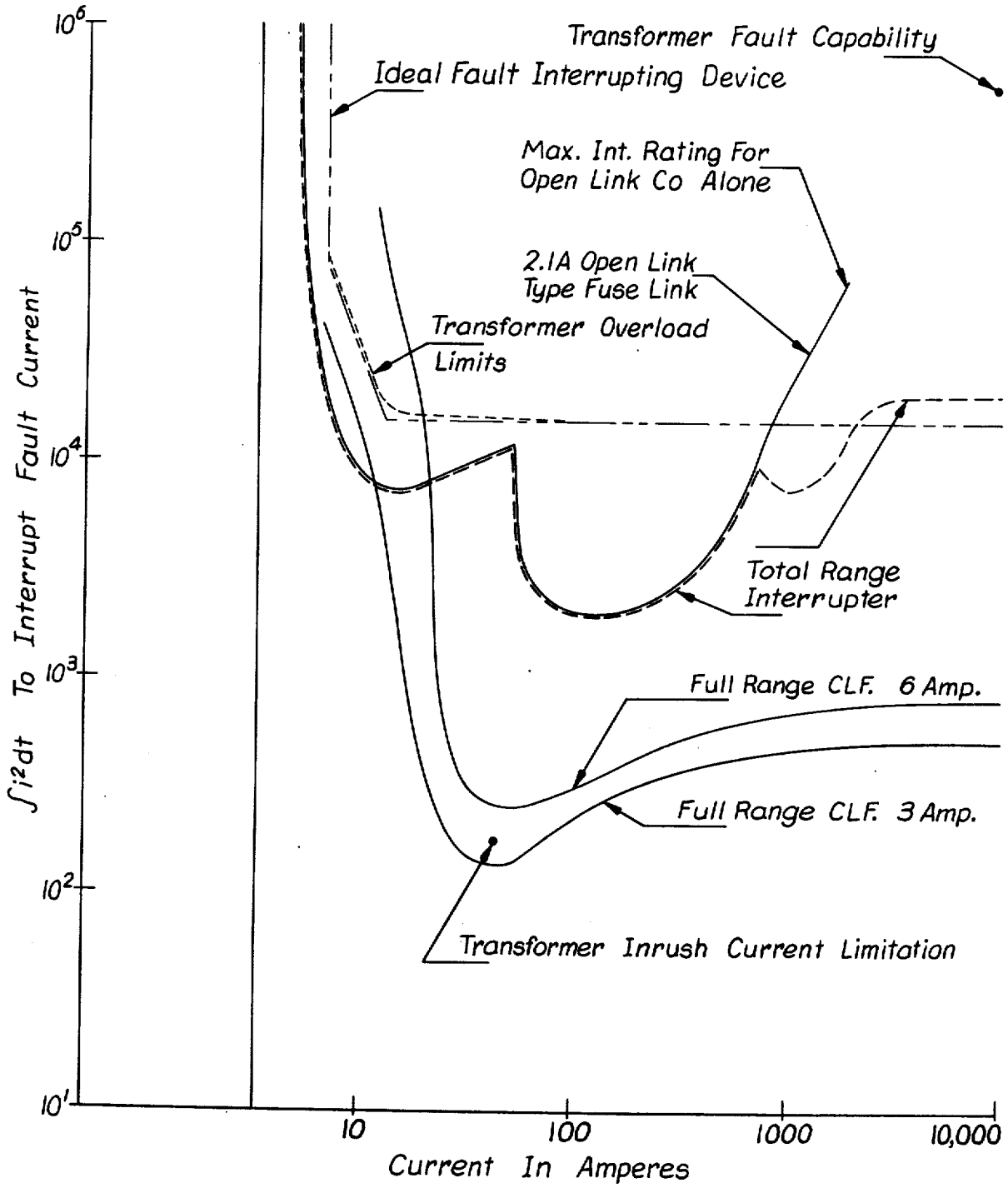

FIG. 6 is a graphical representation of the fault current response of the total range interrupter of this invention, in comparison with an ideal fault current interruption device, one type of conventional cutout fuse link, and two full range current limiting fuses presently available; and FIG. 7 is a plan view showing the lowermost conductive cap of the current limiting fuse shown in detail in FIG. 4.

Figure 1:
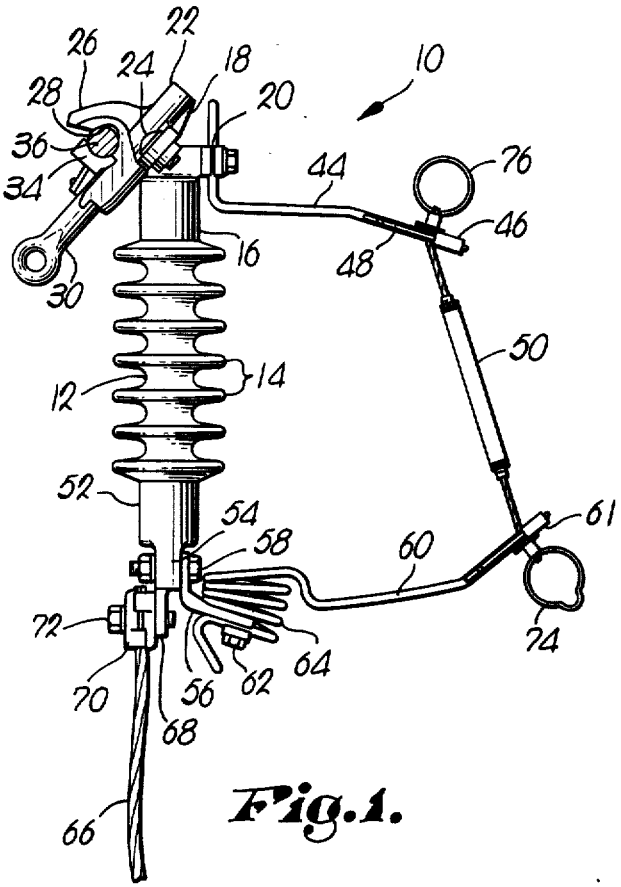
FIG. 1 is a side elevational view showing the open link fault interrupter of the present invention suspended from an overhead power line in a depending fashion.

Referring now to FIG. 1, there is shown a line-mounted open link fault interrupting device generally referred to by the numeral 10. Device 10 includes an elongated, insulative support 12 which includes a series of spaced, circumferentially extending skirts 14 serving to increase the creepage distance between the spaced electrical contacts on the respective ends of support 12.

A generally cylindrical conductive ferrule 16 is integrally attached to the upper end of insulative support 12 and includes an obliquely disposed, integral base section 18 and a forward mounting surface 20. Conductive bracket 22 is removably mounted on base section 18 by means of bolts 24. Bracket 22 is angularly positioned with respect to support 12 and includes an integral, downwardly opening segment 26 which presents an arcuate, conductor-gripping jaw 28 at the lower end thereof.

Figure 5:
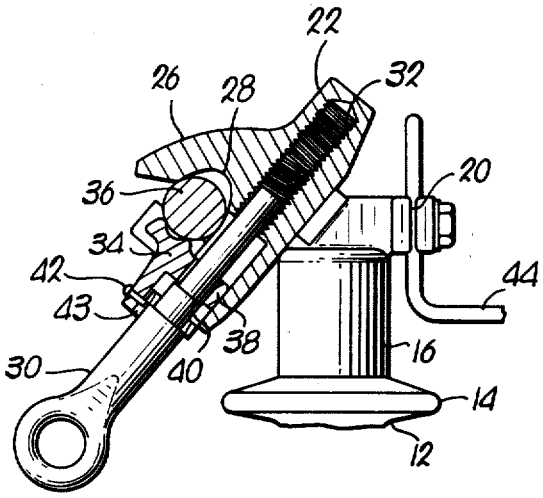
FIG. 5 is an enlarged fragmentary view in vertical section showing in detail the conductor mounting means employed on the open link fault interrupter hereof.

As best shown in FIG. 5, an elongated, threaded key 30 is received within base structure 22 and is threadably advanceable in generally cylindrical, threaded aperture 32 provided at the upper end of bracket 22. Separate, movable, upwardly opening clamp 34 completes the line-gripping section of the device 10, the latter being shiftable in unison with key 30 between an open position permitting suspension of device 10 on an elongated conductor 36 to a closed, line-gripping position as depicted in FIGS. 1 and 5.

Movement of clamp 34 in unison with key 30 is accomplished by provision of an integral, annular ring 38 on clamp 34 which circumscribes the shank of key 30 and abuts integral, radially enlarged flange 40 thereon. As key 30 is rotated in clockwise direction to advance the threaded portion thereof into aperture 32, flange 40 acts to slide clamp 34 progressively closer to jaw 28, and thus into gripping relation with conductor 36. Smooth retraction of clamp 34 is assured by provision of stud 42 extending through the rearmost portion of the clamp, and an annular washer 42 placed about the shank of key 30 rearward of flange 40. As key 30 is retracted, washer 43 engages stud 42 to pull clamp 34 from the operative conductor-gripping position thereof.

A conductive, bifurcated fuse support arm 44 composed of heavy guage wire is connected to the forward mounting surface 20 of integral ferrule 16. Springable fuse-mounting means 46 having rearwardly extending connection arms 48 is attached at the forward end of arm 44 remote from support 12 for the purpose of removably attaching one end of fuse link 50 thereto.

A second cap-like conductive ferrule 52 is integrally attached to the lowermost end of support 12 and includes an integral depending apertured tang 54 having a short extension 68 extending therefrom. An inclined metallic support 56 is attached to the forward face of tang 54 by means of bolt 58. A lower fuse support arm 60 of heavy guage conductive wire is attached to support 56 by means of bolt 62. Arm 60 includes an integral, helical coil spring 64 which rests on inclined support 56 and forms the rearward end of the arm. Fuse-mounting means 61 is also provided having springable, rearwardly directed arms 63 for the purpose of securing open link fuse 50 thereto. As will be more fully described hereinafter, coil spring 64 is operable upon severence of fuse link 50 to bias arm 60 downwardly and thereby increase the flashover distance between respective fuse support arms 44 and 60.

Tap conductor 66 is mechanically and electrically attached to the lowermost extension 68 of tang 54 by means of conventional two-piece clamp structure 70 and bolt 72.

As can be appreciated from a study of the device shown in FIG. 1, current from conductor 36 flows through a circuit including metallic bracket 22, ferrule 16, upper fuse support arm 44, fuse link 50, lower fuse support arm 60, support 56, tang and extension 54 and 68, respectively, clamp structure 70 and conductor 66. Hence, in the normal current-carrying mode, currents of safe magnitudes are effectively carried without interruption thereof.

When an excessively high fault current is experienced however, open link fuse 50 melts or severs at a level dependent on the rating thereof, thus interrupting the current between the spaced support arms 44 and 60. Simultaneously with this action, coil spring 64 biases lower support arm 60 away from upper support arm 44 to effectively preclude flashover therebetween which could occur in instances of intense fault current. Thus, in cases of fault currents within the interrupting capability of link 50, the open link illustrated in FIG. 1 is fully capable of safely interrupting the current to protect nearby interconnected transformers or the like. Moreover, an indicator function is provided by virtue of the fact that linemen in the field can easily observe from ground level whether or not a particular interrupter has operated.

If re-fusing of the open link interrupter is required, it is only necessary to employ a conventional hot-line stick and first connect a new fuse link 50 to lower support arm 60 by grasping O-ring 76 and wedging the lower end of fuse 50 between support 60 and arm 61 (FIG. 1). The fuse is then pulled upwardly and operatively connected in a similar manner to the fuse-mounting means 46 jointed to fuse support arm 44.

During operation of device 10 when fuse link 50 severs or melts, problems associated with pinwheeling and the like are effectively precluded. This stems from the fact that no net rotational force is imparted to device 10 during melting and severing of link 50, as would be the case if the latter were enclosed in a conventional arc-suppressing fuse link tube. Moreover, the hot, conductive gases associated with the severence of link 50 rise harmlessly during operation of the present device in an unconcentrated plume. By way of contrast, when closed link devices are used, a hot, concentrated stream of conductive gases often if directed downwardly onto proximal electrical apparatus, thus leading to possible premature failure thereof and other deleterious effects.

Turning now to FIG. 4, a unique, lightweight current limiting fuse 78 is depicted which is particularly adapted not only from an electrical standpoint but also physically as well to be connected to electrical series with the device 10 described above. Fuse 78 comprises an elongated, hollow, insulative housing 80 having closure means 82 and 84 integrally attached thereto in covering relationship to the opposed ends thereof to present a closed body. Each of the closure means 84 and 86 is provided with an aperture therein, and each has circuit connection structure on the external face thereof respectively adapted to permit fuse 78 to be interposed within an electrical circuit or optionally in series with open link fault interrupter 10.

Upper closure cap 82 is preferably, although not necessarily, composed entirely of conductive metallic material and has an upstanding tang 86 integral therewith which is apertured as at 88 to facilitate electrical and mechanical connection with device 10. Similarly, lower cap 84 is preferably composed of conductive metallic material and is provided with a depending ribbed stud 90.

As depicted in FIG. 4, external housing 80 is hollow and cylindrical in shape and has closure means 82 and 84 integrally connected therewith and sealed by means of epoxy resin bands as shown at 92 and 94 in order to provide a closed, air-tight seal. The relatively thin walled housing 80 is preferably fabricated from a fiber reinforced, thermosetting, synthetic resionous material such as epoxy resin. This provides good insulating qualities, and the resulting housing is strong and rugged, yet light in weight. The closure caps 82 and 84 are provided with apertures 96 and 94 respectively which in turn receive the distal ends of the fusible element 100, later to be described.

The internal assembly of fuse 78 includes an elongated, insulative saddle member 102 which is composed of relatively thin synthetic resin material with a plurality of circumferentially spaced fins 104 radiating from a common longitudinal axis. In preferred forms, the saddle member is composed of synthetic polyethylene terephthalate resin film of from five to ten mils thickness, sold by E. I. Depont De Nemours & Co., Inc. of Wilmington, Delaware, under the trademark "Mylar."

Attachment means are fashioned along the other marginal edges of fins 104 as at 106 for the joining of circumferentially wound fusible element 100 thereto. In preferred forms, the attachment means 106 comprise generally circular saddle openings in communication with the marginal edges of the corresponding fins. These saddle openings have a maximum diameter which is substantially equal to the width of fusible element 100, and are of smaller dimension at the extreme edges of the fins. In this way, the fusible element can be "snapped" into the flexible saddle defining structure and frictionally held therein. Additionally, the openings are preferably arranged along the marginal edges of the fins so that fusible element 100 can be wound in a helical pattern about the circumference of saddle member 102. In this way, element 100 makes very minimal contact with the saddle openings and the saddle support therefor, thus minimizing the possibility of carbonization of the Mylar film during arc formation and extinguishment within fuse 78 which could result in arc restrike.

The elongated fusible element 100 is preferably composed of elemental silver and is of substantially uniform cross-sectional area. A series of spaced transverse slots 108 is provided along the length of element 100 to define zones of decreased cross-sectional area along the length thereof. By provision of such slots, zones of increased electrical resistance are created in element 100 such that when a fault current of predetermined magnitude flows through the element, the latter severs or melts at these points, causing current interruption and thereby limiting of the fault current ahead of the first natural zero point.

The distal ends of the element 100 are stapled or otherwise affixed at 110 to the respective ends of saddle member 102. In this regard, the extreme ends of element 100 are preferably preformed into a substantially semicircular cross-sectional configuration which facilitates their insertion into apertures 96 and 98 of end caps 82 and 84 respectively.

The fuse, according to the invention, can therefore be advantageously constructed in the following manner. First, housing 80 and one end cap 82 or 84 are integrally united; the internal fuse assembly comprising saddle member 102 with fusible element 100 helically wound thereabout is subsequently placed in housing 80 with one end of element 100 extending into respective aperture 96 or 98. An expansion or "pop" rivet 112 is then inserted within the aperture to secure element 100 therein and provide an electrical connection betweent the conductive cap and provide an electrical connection between the conductive cap and fusible element. Housing 80 is then almost completely filled with a pulverulent arc suppressing material 114 (preferably silica sand of about 30 to 70 mesh size), whereupon the remaining end cap is integrally attached to the end of housing 80, with the free end of the fusible element 100 extending through the aperture provided therein. Additional sand is introduced into the body through the open end cap aperture to completely fill the body whereupon connection is completed by insertion of a second pop rivet 112 within the open aperture. Finally, the respective heads of rivets 112 are preferably covered with solder or epoxy material as at 116 in order to insure an airtight seal.

It is to be noted in this respect that fusible element 100 in conjunction with saddle member 102 cooperatively act to position and support the overall internal fuse assembly within housing 80. That is, contrary to the constructions of prior art wherein a heavy porcelain or plastic member was fixedly secured to the end caps, the present lightweight construction remains properly positioned without the need of positively fixed, relatively massive supports. Moreover, this construction maintains the helical convolutions of element 100 in an aligned, spaced relationship so that the fuse maintains its operability even when jostled or otherwise roughly handled.

As can be appreciated, the compact nature of the fuse according to the invention is achieved by virtue of the cooperative support action of the fusible element 100 and saddle member 102. When constructed as outlined above, the fuse is operable to safely limit fault currents of any desired magnitude.

As alluded to previously, open link fault interrupter 10 is particularly adapted to be electrically connected in series with a current-limiting fuse such as that disclosed herein. The resultant combination device is operable to limit both low magnitude and also relatively high fault currents by provision of the current-limiting fuse described.

Figure 2:
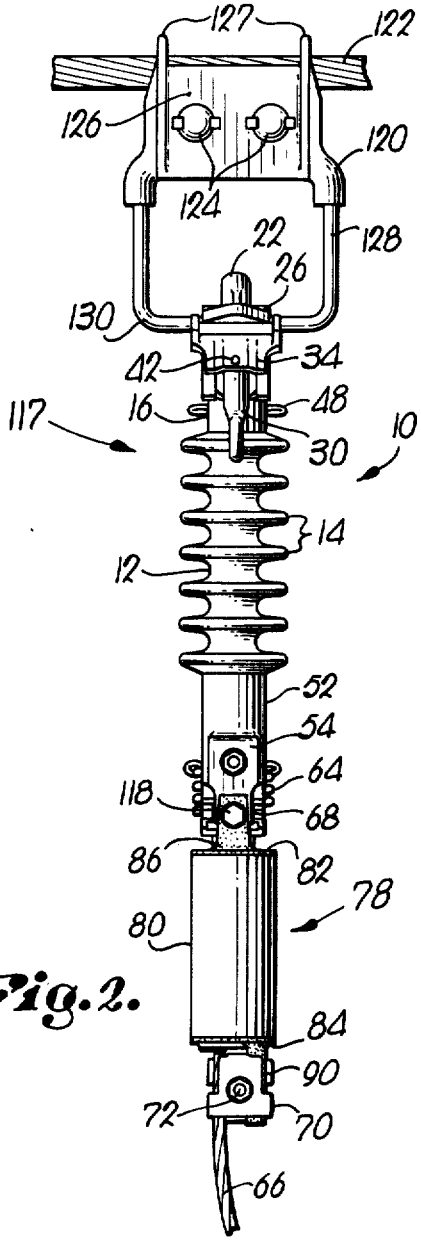
FIG. 2 is a rear elevational view of a novel open link full range current limiting device comprising an open link fault interrupter as depicted in FIG. 1, shown mounted on a conductive bail clamp which is in turn mounted to an overhead power line, in combination with novel current limiting fuse structure in electrical series therewith.

The total range protective device 117 is shown in FIG. 2 as it would appear in one mode of use. In particular, the open link current interrupting device 10 is shown having a current-limiting fuse 78 attached to axial tang 54 by means of bolt 118. Accordingly, conductor 66 is attached to the remaining end of fuse 78 remote from device 10 by means of the conventional two-piece clamp structure 70 and bolt 72.

The upper end of device 10 is exactly as described hereinabove, but in this instance is shown attached to a conventional conductive bail clamp 120. Clamp 120 is hung over elongated overhead conductor 122 and is attached thereto by means of carriage bolts 124 which extend through plate 126 and into operative connection with the arms 127 of clamp 120 suspended over conductor 122. A generally U-shaped bracket 128 depends from plate 126 and includes a generally transverse section 130. As shown in FIG. 2, arcuate jaw 28 and clamp 34 associated with the line-gripping structure of device 10 cooperatively grip section 130 to suspend device 117 therefrom.

As can be appreciated, the use of conductive bail clamp 120 is advantageous in that any movement associated with the overall full range protective device 117 suspended therefrom is not directly transmitted to conductor 122 which tends to prolong the life of the latter. Moreover, if replacement of device 117 is required on an energized conductor 112, any arcing problems would be confined to conductive bail clamp 120 and thus not injure the conductor 122 itself. Accordingly, use of such a conductive bail clamp 120 (either with device 117 or with interrupter 10 alone) is preferred.

Fuse structure 78 and conductor-mounted current interrupting apparatus are both physically and electrically interrelated in device 117 to insure safe and efficient interruption of fault currents exceeding a preselected magnitude. Moreover, device 117 is operable to protect a circuit or piece of equipment while still allowing proper coordination of all the protective devices in a distribution system. One particularly important use of combination device 117 is in protecting distribution transformers from damaging overloads. In this connection it is to be recognized that link fuse 50 in device 10 should have melt characteristics which are optimum for protecting a particular transformer or the like from a damaging fault current while still allowing design loads to be imposed on the transformer windings without actuating the interrupter. Thus, the fuse link used in interrupter 10 should be selected in accordance with known cutout link guidelines taking into account the safe loading characteristics of the equipment to be protected, the degree of overload protection to be provided in the case of transformers, the load current and point of application, the fault current available at various locations on the systems, the time current characteristics of the fuse links to be used on the systems, so that proper coordination thereof can be retained, and the type of protection to be provided by the open link fuse.

In the graphical representation of FIG. 6, typical transformer overload limits for a distribution type transformer are depicted by the dashed lines. For preferred operation, the fuse link chosen for use in interrupter 10 forming a part of the overall combination device 117 (if it is to be used to protect a transformer having overload limits as shown in FIG. 6) should be chosen such that its melt characteristics approach the transformer limits but remain to the left thereof and on or below the same. Typical clearing characteristics of a 2.1 amp fuse link in an interrupter as shown in the drawings hereof are indicated by the appropriately labeled solid line in FIG. 6, but it can be seen that for a high fault furrent, the link total clearing curve is to the left of the transformer fault capability point, which would result in possible explosion of the transformer. Thus, the interrupting characteristics of an ideal fault interrupter for the particular transformer limits shown can be schematically represented by the line made up of long dashes followed by two shorter dashes and which is appropriately labeled.

For comparison purposes, characteristics of two typical full range current-limited fuses as heretofore marketed are also shown schematically in FIG. 6. In the case of a 6 amp full range fuse, the upper part of the curve is to the right of the transformer limit curve, rendering the fuse unsatisfactory for this application. The three amp current-limiting fuse is to the left of the transformer overload curve, but drops below the transformer inrush current limitation point, thus also making use of the three amp fuse impracticable for this application. However, the interrupting characteristics of the combination apparatus employing a 2.1 amp fuse link are illustrated by the appropriately labeled dashed line in FIG. 6 and it can be seen in this instance that the link remains to the left and below the transformer limit line and in between the transformer fault capability point and the transformer inrush current limitation point.

It is thus apparent that when the high range current-limiting fuse structure 78 is connected in electrical series relationship with conductor-mounted, open link interrupter 10, the total range interrupter 117 presented thereby functions in synergistic manner with desirable characteristics which neither of the individual devices possesses alone. To cooperate, both fuses must carry the same fault current. Therefore, a fault (an unintentional flow of hot, high magnitude electrical current from circuit to ground) must not occur between them. Since the possibility of a fault between the low range interrupting apparatus and the high range fuse structure increases with distance of separation, the two devices should be in direct physical contact or preferably as close together as possible.

On especially important advantage of the full range interrupting device is that it operates with much less noise and exposive force than that associated with the open link interrupter alone. In high fault situations with device 117, the open link fuse section thereof first melts, whereupon high range fuse 78 operates to quickly limit the high fault current to a safe level. Although the current limiting fuse 78 can be physically located in a number of different places on open link device 10, the arrangement shown in FIG. 2 is perferable for several reasons. First, in this case, conductive gas developed during melting of open link fuse 50 rises in a relatively unconcentrated plume, thus precluding flashover between the spaced contacts on fuse 78. Additionally, the fuse 78 is not likely to be scorched by such gasses, which could lead to premature failure.

When a current-limiting fuse 78 as disclosed herein is electrically connected in series with a line-mounted open link fault interrupter 10, and a fault current of magnitude sufficient to melt the fuses is experienced, the following is belived to occur. When the fault current enters the fuse 78, it experiences highest resistance at the points of minimum cross-sectional area along the length of fusible element 100, i.e., at points coincident with the spaced transverse slots 108. These zones of decreased cross-sectional areas are substantially and instantaneously vaporized and explode into individual arcs. The arcs lengthen as they continue to vaporize more of the silver fusible element 100, and soon the sum of their voltage drops surpasses the normal system voltage. The high total arc voltage thus forges the fuse current to zero before it ever reaches the peak value of the available fault current. Simultaneously, the sand 114 serves to suppress the arc by interposing a high arc resistance in its path. This causes sand to partially vaporize along with the silver atoms (an in some instances minor perforations of the thermal plastic saddle member adjacent fusible element) and both soon form a glassy matrix which is nonconductive. At this point, current through the fuse is completely interrupted, and restriking of the arc is precluded because the dielectric path is sufficiently high to withstand any recovery voltage up to the maximum design voltage. The action of the current-limiting fuse is silent and substantially nonventing as all of the energy of interruption is retained within sealed housing 80.

When full range device 117 is operatively positioned within an electrical circuit as a protective device therefor, the following occurs upon introduction of a fault current therethrough. If the fault is only of sufficient magnitude to actuate interrupter unit 10, fuse link 50 thereof will sever to interrupt the fault in the well-known manner. However, if the fault is of such magnitude which would normally overload the open link device, fuse 78 is operable to interrupt as described, to effectively and safely limit the fault without the voilence and noise which could result if only an open link interrupter 10 were present. Accordingly, combination device 117 is of the "full range" variety and is operable to protect distribution equipment from all fault currents up to the designed capability thereof. Moreover, since interrupter 10 is actuated at lower magnitude fault currents than fuse 78, the former will give a positive indication of operation by virtue of the spacing between fuse link support arms 44 and 60.

Figure 3:
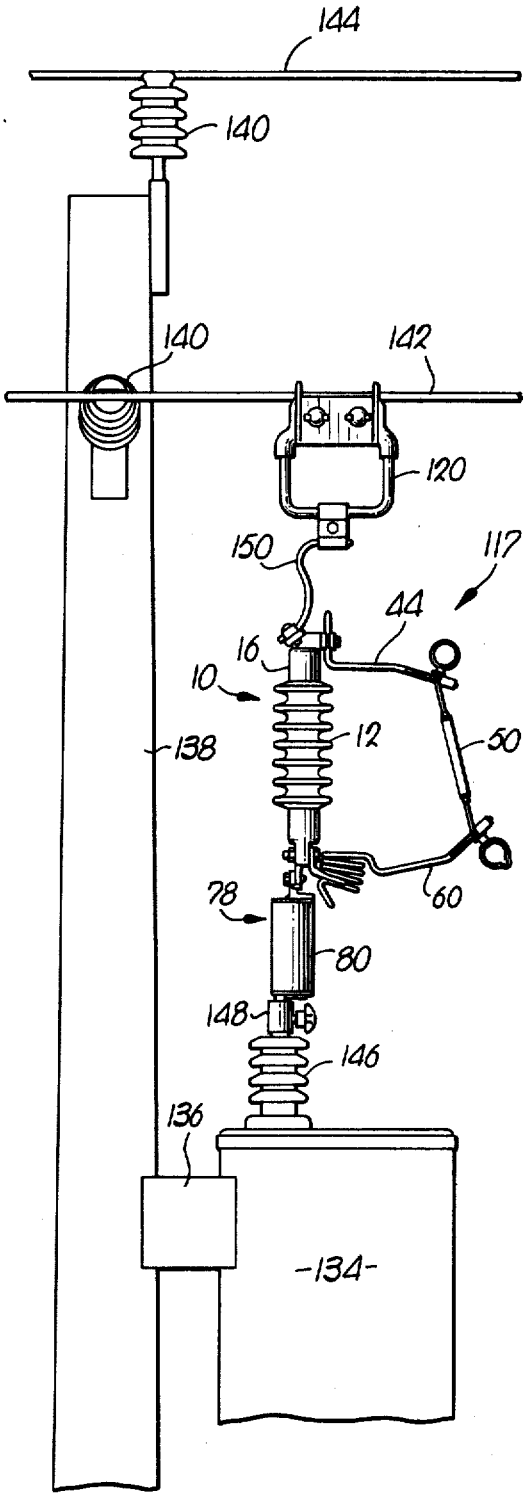
FIG. 3 is a fragmentary, side elevational view showing the total range fault interrupting device of FIG. 2 mounted directly on a pole-mounted transformer with means electrically connecting the device to an overhead power line.

In another embodiment employing the full range protective device 117 hereof, such device is mounted directly upon a pole-mounted transformer 134. Referring specifically to FIG. 3, transformer 134 is connected by means of support structure 136 to upright armless utility pole 138 provided at the upper end thereof with pole top insulators 140 serving to support the spaced conductors 142 and 144.

Device 117 is attached in an upright manner to transformer 134 through skirted insulator 146 by means of conventional collar attachment therefor on upper conductive ferrule 16 forming a part of interrupter 10, and conductive bail clamp 120, the latter being in secure electrical and mechanical connection with conductor 142. In this instance therefore, the requisite full range fault interruption is provided by device 117, without the need for direct mounting on the overhead conductor. Furthermore, there is no requirement in this case of separate pole-mounting structure for device 117, thereby minimizing the cost of the assembly as well as problems associated with installation of the same. The operational characteristics of device 117, when installed directly onto transformer 134, are identical to those described above in the case of the conductor-mounted full range fault interrupter.

Having thus described the invention, what is claimed as new and desired to be secured by letters patent is:

1. An open link fault interrupter adapted to be interposed in an electrical circuit in series between a pair of conductors and comprising:

an elongated, insulative support;

mounting means on said support for gripping one of said conductors and suspending said interrupter from said one conductor in a depending relationship therefrom, the gripping connection between said mounting means and one conductor serving as the sole support for said interrupter;

a first conductive fuse support arm extending from said support and adapted to be electrically connected to said one conductor when said interrupter is mounted thereon;

a second conductive fuse support arm spaced from said first arm and extending from said support, said second arm being adapted to be electrically connected to the other of said conductor when said interrupter is interposed in said circuit;

an open link fusible element electrically interconnected between said first and second fuse support arms, said element being operable to sever upon experiencing a fault current of predetermined magnitude to thereby interrupt said current; and means on said first and second arms for securing said fusible element therebetween.

2. The fault interrupter as set forth in claim 1 wherein said support is provided with a series of spaced, circumferentially extending skirts.

3. The fault interrupter as set forth in claim 1, wherein said mounting means is composed of conductive metal and comprises:

bracket means secured to the uppermost end of said support in oblique relationship to the longitudinal axis of the latter, said bracket means having an arcuate, downwardly opening conductor gripping jaw segment;

clamp means having an upwardly opening arcuate, conductor gripping face and movable between an open position permitting hanging of said jaw segment on said one conductor, to a closed position wherein said jaw segment and clamp means cooperatively grip said one conductor; and means for moving said clamp means between the open and closed positions thereof.

4. The fault interrupter as set forth in claim 3, wherein said first fuse support arm is electrically connected to said bracket means.

5. The fault interrupter as set forth in claim 1, wherein said second fuse support arm is provided with biasing means operable to urge said second arm in a direction to increase the distance between said arms upon severing of said fusible element.

6. The fault interrupter as set forth in claim 5, wherein said biasing means comprises a coil spring.

7. In combination:

high range current limiting fuse structure connected in series with low-range current interrupting apparatus, the latter comprising:

an elongated, insulative support:

mounting means on said support for gripping an overhead conductor and suspending said interrupter from said conductor in a depending relationship therefrom, the gripping connection between said mounting means and said conductor serving as the sole support for said interrupter;

a first conductive fuse support arm extending from said support and being electrically connected to said conductor when said apparatus is mounted thereon;

a second conductive fuse support arm spaced from said first arm and extending from said support, said second arm being electrically connected to said serially connected current limiting fuse structure;

a low-range, open link fusible element interconnected between said first and second fuse support arms, said element being operable to sever upon experiencing a fault current of predetermined low magnitude to thereby interrupt said current; and means on said first and second arms for securing said fusible element therebetween, said apparatus and current limiting fuse structure being cooperable to effect interruption of low and high magnitude fault currents with substantial isoenergy dissipation within predetermined, relatively narrow limits under all fault interruptions experienced thereby.

8. The combination as set forth in claim 7, wherein said support is provided with a series of spaced, circumferentially extending skirts.

9. The combination as set forth in claim 7, wherein said mounting means is composed of conductive metal and comprises:

bracket means secured to the uppermost end of said support in oblique relationship to the longitudinal axis of the latter, said bracket means having an arcuate, downwardly opening conductor gripping jaw segment;

clamp means having an upwardly opening, arcuate, conductor-gripping face and movable between an open position permitting hanging of said jaw segment on said conductor, to a closed position wherein said jaw segment and clamp means cooperatively grip said conductor; and means for moving said clamp means between the open and closed positions thereof.

10. The combination as set forth in claim 9, wherein said first fuse support arm is electrically connected to said bracket means.

11. The combination as set forth in claim 7, wherein said second fuse support arm is provided with biasing means operable to urge said second arm in a direction to increase the distance between said arms upon severing of said fusible element.

12. The combination as set forth in claim 11, wherein said biasing means comprises a coil spring.

13. The combination as set forth in claim 7, wherein said high-range current limiting fuse structure comprises:

an elongated, hollow insulative housing;

closure means attached to said housing in covering relationship to opposed ends thereof to present a closed body, each of said closure means having conductive connection structure on the external face thereof respectively adapted to permit said fuse to be interposed within an electrical circuit;

at least one relatively thin, elongated fusible element within said housing, the distal ends of said element being adapted for electrical connection with said respective external connection structure of said closure means;

means electrically connecting each of said external connection structure with the distal ends of said fusible element to thereby create a current path through said fuse;

a series of spaced zones along the length of said element within the housing having decreased cross-sectional areas relative to the remainder of the element, the ratio of the maximum cross-sectional area to the minimum cross-sectional area thereof being sufficiently high to cause said high-range fuse to limit fault currents only of said high magnitude by the severance of said element at said zones of decreased cross-sectional area;

an elongated, insulative saddle member of synthetic resin material having a plurality of circumferentially-spaced fins, said fins being provided with spaced attachement means at predetermined points about the marginal edges thereof for the attachment of said fusible element, said fusible element being helically wrapped about said saddle member and attached thereto by said attachment means to form an internal fuse assembly, said saddle member and fusible elements cooperatively acting to position and support each other within said housing with the convolutions of said elements being maintained in an aligned, spaced relationship about said saddle; and to arc-suppressing material within said closed body in substantially surrounding relationship to the convolutions of said element, said material being characterized by the property of acting so quickly suppress the electrical arc formed upon the severing of said fusible element under the influence of a fault current.

14. The combination as set forth in claim 13, wherein said closure means is provided with apertures therein receiving respective distal ends of said fusible element and said means for electrically connecting the distal ends of said elements with said respective connective structure comprises:

mechanical connection means within said apertures adapted to seal said closed body and secure said distal ends of the fusible element therein; and means electrically connecting said mechanical connection means and said respective external connection structure, thereby providing a current path through said fuse.

15. The combination as set forth in claim 14, wherein said mechanical connection means comprises expandable rivets operatively positioned in said apertures to secure said fusible elements within said housing.

* * * * *